United States Patent [19]

Johnson

[11] 4,026,411

[45] May 31, 1977

[54] HOLLOW WALL DISPLAY CARTON

[75] Inventor: Fred J. Johnson, Long Beach, Calif.

[73] Assignee: Container Corporation of America, Chicago, Ill.

[22] Filed: June 7, 1976

[21] Appl. No.: 693,157

[52] U.S. Cl. ..... 206/45.19; 229/14 C; 229/16 D

[51] Int. Cl.[2] ..... B65D 5/50

[58] Field of Search ..... 206/45.19, 45.14; 229/14 C, 16 D, 29 F, 33, 36 R, 39 R, 23 A

[56] References Cited

UNITED STATES PATENTS

| | | | |
|---|---|---|---|
| 3,095,086 | 6/1963 | Berg | 206/45.19 |
| 3,741,380 | 6/1973 | Carney | 206/45.19 X |

*Primary Examiner*—George T. Hall
*Attorney, Agent, or Firm*—Carpenter & Ostis

[57] ABSTRACT

A hollow wall display carton formed of foldable paperboard, for holding at least one packaged article, which includes a platform which is co-extensive with and spaced above the bottom wall.

7 Claims, 5 Drawing Figures

HOLLOW WALL DISPLAY CARTON

SUMMARY OF THE INVENTION

The invention relates to paperboard display cartons of the type wherein at least a portion of the side and end walls are hollow and which includes an internal platform spaced from the bottom wall, for holding at least one packaged article.

In the past certain hollow wall or frame-style cartons have been provided with interior, horizontal article retaining platforms which extend between the inner panels of the carton side and end walls. In such arrangements, especially when the packaged articles are heavy, the platform may shift vertically or laterally causing the hollow side walls to buckle or distort, thereby spoiling the appearance of the cartons.

It is therefore an object of the present invention to provide in a carton of the type described, a means for preventing the lateral or vertical shifting of the platform within the carton.

A more specific object of the invention is to provide a platform having a main panel which extends all the way to the outer side and end walls of the carton and which is engaged by vertical panels which prevent the main panel from moving upwardly or downwardly from its normal position.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 2:
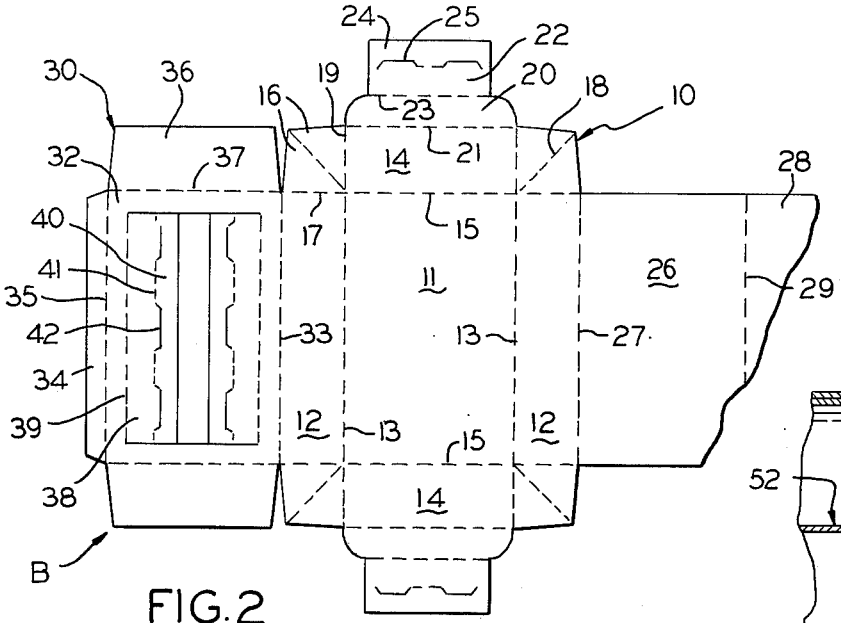
FIGS. 2 and 3 are plan views of blanks of foldable paperboard from which the carton may be formed.
Figure 3:
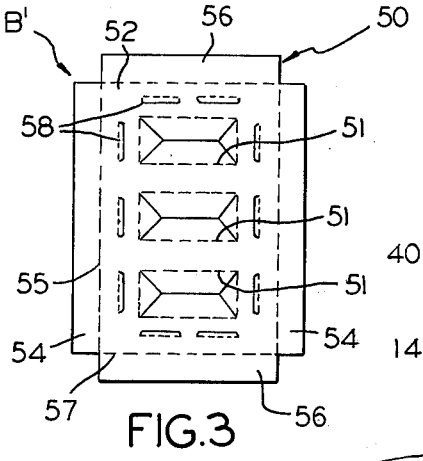

Referring now to the drawings for a better understanding of the invention, it will be seen that a carton, indicated generally at C, embodying features of the invention may be formed from the unitary blanks B and B′ of foldable paperboard which are illustrated in FIGS. 2 and 3 of the drawings. The carton is of the so called hollow wall or frame style and includes an inner platform for retaining one or more packaged articles indicated generally at A.

The body or main portion of the carton is indicated generally at 10 and includes a preferably rectangular bottom wall 11 having opposed pairs of side and end walls 12 and 14, foldably connected to opposite side and end edges along fold lines 13 and 15 respectively. At each corner of the carton the adjacent edges of the side and end walls may be interconnected by a pair of generally triangular gussets 16 which are foldably connected to the side and end walls along fold line 17 and 19 and which are foldably connected to each other along a generally diagonal fold line 18.

Each end wall 14 has foldably connected to its upper edge along fold line 21 an outer top wall panel 20 which extends inwardly from the end wall and which has foldably connected to its inner edge along fold line 23, a depending end wall inner panel 22. Foldably connected to the lower extremity of end wall inner panel 22 is an anchor panel 24 which is disposed to extend outwardly at a 90° angle from the end wall inner panel to the end wall. It will be noted that each end wall inner panel 22 is provided at its lower extremity with one or more locking tabs 25, the purpose of which is described later in the specification.

Figure 1:
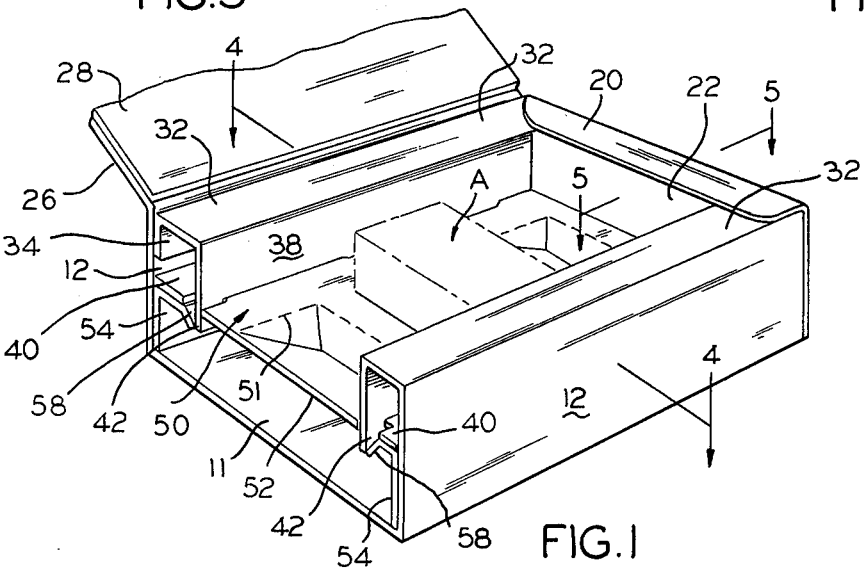
FIG. 1 is a perspective view of a carton embodying features of the invention.

Referring to FIGS. 1 and 2, it will be seen that there may be provided a cover which includes a cover outer panel 26 foldably connected along fold line 27 to the upper edge of one side wall 12 and a cover inner panel 28 foldably connected along fold line 29 to the opposite edge of the outer panel 26 and folded over 180° so as to lie in face-to-face relationship with inner panel 26. If desired the inner and outer panels may be secured to each other in any acceptable manner.

Figure 5:
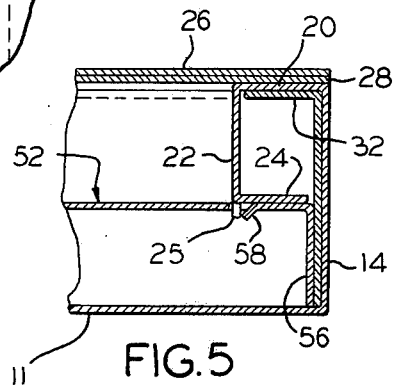
FIG. 5 is a vertical section taken on line 5—5 of FIG. 1.
Figure 4:
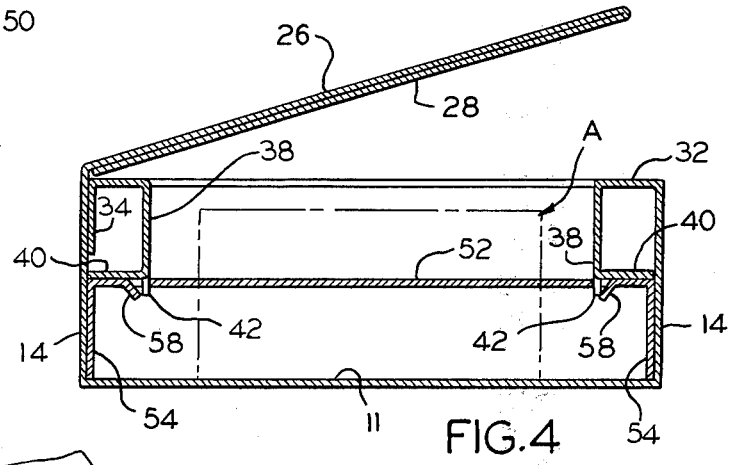
FIG. 4 is a vertical section taken on line 4—4 of FIG. 1.

Still referring to FIGS. 1 and 2, it will be seen that the hollow wall or frame structural arrangement of the carton body is accomplished by an integral body top section indicated generally at 30 which includes a relatively narrow rectangular upper wall 32 bordering the periphery of the body portion and being open in the center. One side edge of the top wall 32 is foldably connected along fold line 33 to the upper edge of the side wall 12 opposite the side wall to which the cover is attached. At its opposite side, top wall 12 has foldably connected thereto along fold line 35 a depending flange 34 which is disposed to lie against the inner surface of the side wall panel 12 to which the cover is attached, as best seen in FIG. 4. Foldably connected to each end of top wall 32 along fold line 37 is a depending flange 36 which is generally co-extensive with the related end wall 14 and which is disposed to lie against the inside surface thereof in full face engagement therewith as best seen in FIG. 5.

Foldably connected at their upper edges along fold lines 39 to the inner edges of each of the sides of top wall 32, are a pair of downwardly extending inner side wall panels 38 which have foldably joined to their lower edges along fold lines 41 anchor panels 40 which extend outwardly to the related side walls 12. It will be noted that at their lower edges inside side wall panels 38 present locking tabs 42, the purpose of which is described later in the specification.

Referring now to FIGS. 1 and 3, it will be seen that the carton is provided with a separate platform insert indicated generally at 50 which is generally rectangular and includes one or more central openings 51 extending therethrough for positioning and retaining one or more packaged articles in the carton.

Platform insert 50 includes a generally rectangular, horizontally disposed main panel 52 which is co-extensive with bottom wall 11 of the carton and is spaced above the bottom wall a distance equal to approximately one half of the height of the side and end walls of the carton. Foldably connected to the side and end edges of main panel 52 along fold lines 55 abd 57 are opposite pairs of depending flanges 54 and 56 which are disposed to lie against the inner surfaces of the side and end walls of the carton body.

It will be noted that around the periphery at the sides and ends of main panel 52 there are provided a plurality of slots 58 which are adapted to receive the locking tabs 25 and 42 of the end and side wall inner panels, as best seen in FIG. 1, to retain the platform 50 in position.

Thus because the platform is co-extensive with the bottom wall and extends all the way to the side and end walls of the carton, and by virtue of the side and end wall inner panels and the platform flanges, vertical movement of the platform is also restricted. This is believed to represent a substantial improvement over known hollow wall cartons of the type having platforms wherein the platforms extend only to the inner side wall panels so that when it shifts position there is likely to be a distortion or deflection of the inner side wall panels.

Although in the foregoing description and drawings the platform portion of the carton is described and illustrated in the form of a foldable paperboard component, it is to be understood that the platform or insert may be formed as a hollow molded or thermo-formed commponent or as a generally solid block of material such as styrofoam. Regardless of the material used for the insert, the principle of the invention is the same. That is to provide an article holding insert that extends to the side and end walls of the body or tray portion of the carton and is supported by the bottom wall and wherein the upper portion of the carton body includes inner side and end wall panels extending down to the insert.

I claim:

1. In a reinforced, hollow wall, display carton, formed of foldable paperboard, for holding at least one packaged article, the combination of:

a. a body including a bottom wall and opposed pairs of side and end walls foldably connected to and upstanding from the side and end edges of said bottom wall and connected to each other to form a tray-like structure open at the top;

b. a horizontally disposed platform in said body including:

i. a main panel co-extensive with and spaced above said bottom wall;

ii. opposed pairs of flanges foldably connected at their upper edges to the side and end edges of said main panel and extending downwardly therefrom to said bottom wall inwardly adjacent said body side and end walls, respectively;

iii. said main panel presenting at least one opening extending therethrough for retaining a packaged article in spaced relation to said body walls;

c. said body including opposed pairs of side and end wall inner panels spaced inwardly from said side and end walls, respectively, and connected thereto by a relatively narrow top wall;

d. said inner wall panels extending downwardly to said platform main panel.

2. In a reinforced, hollow wall, display carton for holding at least one packaged article, the combination of:

a. a body formed of foldable paperboard and including a bottom wall and opposed pairs of side and end walls foldably connected to and upstanding from the side and end edges of said bottom wall and connected to each other to form a tray-like structure open at the top;

b. a separate insert positioned within said body and presenting a generally horizontally disposed platform surface having at least one recess therein for retaining a packaged article;

c. said insert having side and end edges extending to and in engagement with the side and end walls, respectively, of said body, and having portions engageable with and supported by the bottom wall of said body;

d. said body including opposed pairs of side and end wall inner panels spaced inwardly from said side and end walls, respectively, and connected thereto by a relatively narrow top wall;

e. said inner wall panels extending downwardly to said insert.

3. A display carton according to claim 2, wherein said side and end wall inner panels have their lower extremities diposed in engagement with said insert.

4. A display carton according to claim 2, wherein said side and end wall inner panels have foldably connected to their lower ends anchor panels lying in face-to-face relation with the platform surface of said insert and extending outwardly to said side and end walls, respectively.

5. A display carton according to claim 2, and including end flanges extending downwardly from the edges of said top wall and being generally co-extensive with and disposed to lie against the inner faces of said end walls.

6. A display carton according to claim 2, wherein said insert is formed of foldable paperboard.

7. A display carton according to claim 2, wherein said insert comprises a generally solid block of material.

* * * * *